US007087829B2

(12) United States Patent
Hasegawa et al.

(10) Patent No.: US 7,087,829 B2
(45) Date of Patent: Aug. 8, 2006

(54) METHOD, SYSTEM AND RECORDING MEDIUM FOR VIEWING/LISTENING EVALUATION OF MUSICAL PERFORMANCE

(75) Inventors: Yutaka Hasegawa, Hamamatsu (JP); Shinji Koezuka, Hamamatsu (JP); Nobuo Tsunashima, Hamamatsu (JP); Masaya Okura, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 359 days.

(21) Appl. No.: 09/953,536

(22) Filed: Sep. 12, 2001

(65) Prior Publication Data

US 2002/0066358 A1 Jun. 6, 2002

(30) Foreign Application Priority Data

Sep. 13, 2000 (JP) ..... 2000-278861

(51) Int. Cl.
*A63H 5/00* (2006.01)
*G04B 13/00* (2006.01)
*G10H 7/00* (2006.01)

(52) U.S. Cl. ..... 84/609; 700/91; 705/12

(58) Field of Classification Search ..... 700/91; 705/1, 11, 12, 14; 84/609
See application file for complete search history.

(56) References Cited

U.S. PATENT DOCUMENTS 5,694,162 A * 12/1997 Freeny, Jr. ..... 725/116
6,439,997 B1 * 8/2002 Brasseur et al. ..... 463/40
6,443,840 B1 * 9/2002 Von Kohorn ..... 463/17
2002/0010628 A1 * 1/2002 Burns ..... 705/14
2002/0029684 A1 * 3/2002 Hasegawa et al. ..... 84/609
2002/0065826 A1 * 5/2002 Bell et al. ..... 707/10

OTHER PUBLICATIONS

Crecente, Brian D., "SIte Offers Free Music, Asks for Listeners'Views," Nov. 11, 2000, The Palm Beach Post, p. 3D.*
Cummings, Sue, "Online Music Surveys Look for Future Hits," Feb. 2, 2001, NY Times.*
Radio and Internet Newsletter, Apr. 13, 2000.*
Radio Ink Magazine, May 2000.*
Pickthehits.com, FAQs, About Us, Rules. copyright 2002.*
"Yamaha Will Open A New Artists Discovery Site 'Music Front'", Music Trades, Japan Music Trade Co., Ltd., Jul. 1, 2000, vol. 38, No. 7, p. 76.
"Yamaha Starts A New Artist Audition On The Net Today", Japan Industrial Journal, Jun. 9, 2000, p. 10.

* cited by examiner

*Primary Examiner*—Jeffrey W Donels
(74) *Attorney, Agent, or Firm*—Morrison & Foerster LLP

(57) ABSTRACT

A music work filed for application through on-line transmission or the like is subjected to viewing/listening by audiences through plural kinds of media. The audiences make access to an internet homepage on an internet server 4 of the holder of the audition through a PC (personal computer) 1 or 2, and performs trial-listening of the music work. The audiences also view and/or listen to a live performance in a performance hall. Alternatively, the audiences may view and/or listen to a video performance of television broadcast. Evaluation data based on the results of viewing/listening is input on the internet homepage by the audiences through a PC 6 or a portable communication terminal device 7 on evaluation items conforming to the characteristics of the media. A music work is selected based on the above evaluation.

15 Claims, 11 Drawing Sheets

FIG.8A

[evaluation page]

name of artist: ABCDEFG artist profile: student group from Hamamatsu-shi, Shizuoka-ken, Japan ····· title of music: HIJKLMN music profile (PR): ····· lyrics: ····· (about 100 letters)

(photograph)

evaluation sheet (up to 10 points for each evaluation item)

A: lyrics ( ▽)

B: melody ( ▽)

C: arrangement, goodness of performance ( ▽)

D: vocal (goodness of singing) ( ▽)

E: originality (creativity) ( ▽)

comments (within 100 letters): ( )

"if delivered, do you wish to purchase ?"

absolutely yes, probably yes, not decided yet I do not wish to purchase transmit

SB

METHOD, SYSTEM AND RECORDING MEDIUM FOR VIEWING/LISTENING EVALUATION OF MUSICAL PERFORMANCE

BACKGROUND OF THE INVENTION

1. Field of the Invention

The present invention relates to a method, a system, and a recording medium for viewing/listening evaluation of a musical performance for selecting a more excellent music work efficiently and with certainty by allowing general audiences to view and listen to music works (the musical performance of the music works), which are presented by numerous applicants, through an internet homepage and other media, and allowing the audiences to evaluate the music works using the internet homepage on evaluation items corresponding to the respective media.

2. Description of the Background Art

Hitherto, audition of music works created by amateurs includes an open audition performed in front of general audiences, an internal audition based on and by using recording medium such as a tape and CD recording a performance, sent in advance to an audition holder (i.e. a person or an organization who holds an audition), and others. In each audition, examiners consisting of experts evaluate the music works. An especially excellent music work found out on the basis of the evaluation goes through the steps of making a contract, receiving advice of experts for rerecording of the music work, fabricating a CD of the music work, and selling the CD to general public.

The aforesaid evaluation is typically carried out by an extremely limited number of examiners consisting of experts on music, and hence does not include evaluation by general audiences (mainly young people) who are major consumers of music CDs, music delivery, through, for example the internet, and others. For this reason, the CD or the like of the selected music work may not be accepted by the general audience when the CD or the like is sold to public. Also, the general audiences miss a chance of meeting a music work that can gain a contemporary compassion, because the general audiences listen only to the music works extracted in advance by a limited number of experts.

The present invention has been made in light of such a background, and an object thereof is to provide a method, a system, and a recording medium for viewing/listening evaluation of a musical performance (a musical works) in which evaluation and selection of the performance can be efficiently carried out on the basis of the sensitivities (preferences) of general audiences, so that music works that can withstand general marketing to a larger extent (i.e. the music works that become hit works) can be extracted, and the general audiences are given a chance to be brought into contact with numerous music works filed for application for the audition and can find, meet, and enjoy music works that can gain a compassion of the general audiences by allowing the general audiences to view and/or listen to the music works, which have been filed for application, through plural media such as an internet homepage, allowing the audiences to input evaluations (evaluation data) corresponding to the characteristics of the respective media on and through the internet homepage, and examining the music works on the basis of the input evaluations.

SUMMARY OF THE INVENTION

A method for viewing/listening evaluation of musical performance according to the first aspect of the present invention is characterized by including the steps of: storing introduction data and performance data of a music work filed for application (for an audition) through a network or a recording medium; publicizing the introduction data of the music work on an internet homepage, transmitting at least a part of the performance data of the music work to audiences through the internet to allow the audiences to view and/or listen to the performance in accordance with a request from the audiences, and allowing the audiences to input evaluation data on a first evaluation item (on and through the internet homepage) on the basis of viewing/listening results; allowing the audiences to view and/or listen to the performance through a different medium (through a medium other than the internet), and allowing the audiences to input data on a second evaluation item (on and through the internet homepage) on the basis of viewing/listening results; and comprehensively evaluating the music work on the basis of the input data on the first and second evaluation items.

A method for viewing/listening evaluation of musical performance according to the second aspect of the present invention is characterized in that the first evaluation item comprises an item that can be determined by listening to a performance of the music work, and the second evaluation item comprises an item that can be determined by seeing and listening.

A method for viewing/listening evaluation of musical performance according to the third aspect of the present invention is characterized in that the viewing/listening on the internet homepage includes streaming reproduction of the stored performance data of the music work through the internet for allowing the audiences to listen to the performance of the music work.

A method for viewing/listening evaluation of musical performance according to the fourth aspect of the present invention is characterized in that the viewing/listening through the different medium includes viewing/listening of a live performance of the music work by an applicant, or viewing/listening of a video images and sound of the live performance (that is transmitted or broadcast to the audiences).

A method for viewing/listening evaluation of musical performance according to the fifth aspect of the present invention is characterized by further including the step of delivering and selling on and through the internet homepage the performance data of a music work that has been evaluated to be good (i.e. that has gained a predetermined score) in the comprehensive evaluation.

A system for viewing/listening evaluation of musical performance according to the sixth aspect of the present invention is characterized by including: storage means for storing introduction data and performance data of a music work filed for application through a network or a recording medium; first control means for publicizing the introduction data of the music work on an internet homepage, transmitting at least a part of the performance data of the music work to audiences to allow the audiences to view and/or listen to the performance in accordance with a request from the audiences, and allowing the audiences to input data on a first evaluation item on the basis of viewing/listening results; second control means for allowing the audiences to view and/or listen to the performance through a different medium, and allowing the audiences to input data on a second evaluation item on the internet homepage on the basis of viewing/listening results; and evaluation means for comprehensively evaluating the music work on the basis of the input data on the first and second evaluation items.

A recording medium according to the seventh aspect of the present invention is characterized by including: a storage module for storing introduction data and performance data of a music work filed for application through a network or a recording medium; a first control module for publicizing the introduction data of the music work on an internet homepage, transmitting at least a part of the performance data of the music work to audiences to allow the audiences to view and/or listen to the performance in accordance with a request from the audiences, and allowing the audiences to input data on a first evaluation item on the basis of viewing/listening results; a second control module for allowing the audiences to view and/or listen to the performance through a different medium, and allowing the audiences to input data on a second evaluation item on the internet homepage on the basis of viewing/listening results; and an evaluation module for comprehensively evaluating the music work on the basis of the input data of the first and second evaluation items.

A method for viewing/listening evaluation of musical performance according to the eighth aspect of the present invention is characterized by including the steps of: storing data of a music work filed for application through a network or a recording medium; allowing audiences to view and/or listen to the music work through plural media including an internet homepage, and allowing the audiences to input data on respective evaluation items corresponding to characteristics of the media on the internet homepage every time the audiences view and/or listen to the music work; and comprehensively evaluating the music work on the basis of input data on the evaluation items of the plural media.

BRIEF DESCRIPTION OF THE DRAWINGS

FIG. 8A is a screen for inputting an evaluation carried out on the basis of trial listening on an internet homepage;

DESCRIPTION OF THE PREFERRED EMBODIMENTS

Figure 1:
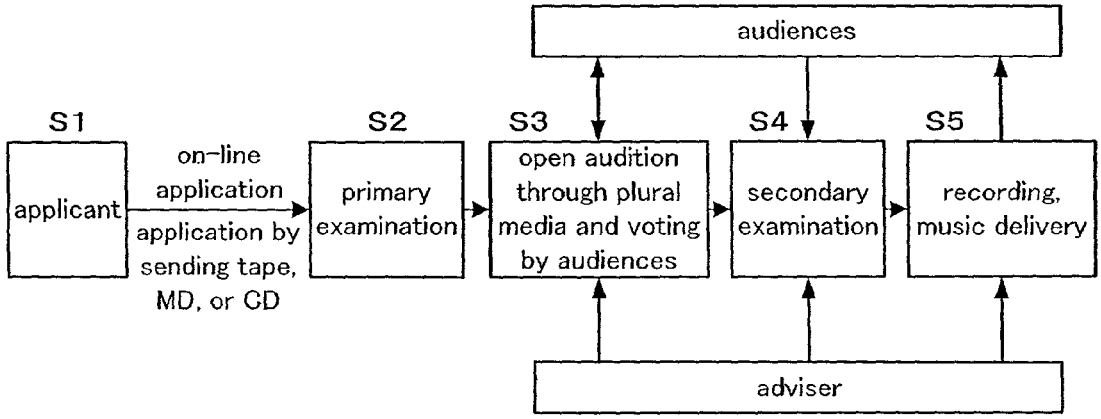
FIG. 1 is a flow chart showing a basic flow of a system and method for viewing/listening evaluation of musical performance according to the present invention.

Hereafter, preferred embodiments of the present invention will be described with reference to the attached drawings. FIG. 1 is a block diagram illustrating a schematic flow of a system (hereafter referred to as "present system") and a method for viewing/listening evaluation of musical performance according to the present invention. The basic flow of the system will be described with reference to FIG. 1. Referring to step S1 of FIG. 1, each applicant sends a performance data (playing data, i.e. data for reproducing actual performance of the music work by the applicant) and an introduction text data of the applicant's music work to the evaluator side through on-line transmission or by using a storage medium and paper. The music work filed for application for an audition is first subjected to a primary (first) examination by an evaluator, an adviser on the evaluator side, or the like (step S2). The music work that has passed the primary examination is publicized through plural media such as an internet homepage, a live performance, or a television broadcast, and is subjected to viewing/listening by general audiences that have agreed with the evaluator's intent and have been registered in advance, whereby the music work is evaluated on the internet homepage on evaluation items corresponding to the media (step S3). The music work that has passed the secondary examination (step S4) based on the evaluation of the registered audiences are subjected to full-scale recording under a guidance of an adviser or the like to be publicized on an internet homepage of the evaluator as an excellent music work that can withstand marketing, and is delivered to those who wish to purchase the music work with charge (step S5). Together with the music delivery, marketing through a medium such as a CD may be carried out.

Figure 2:
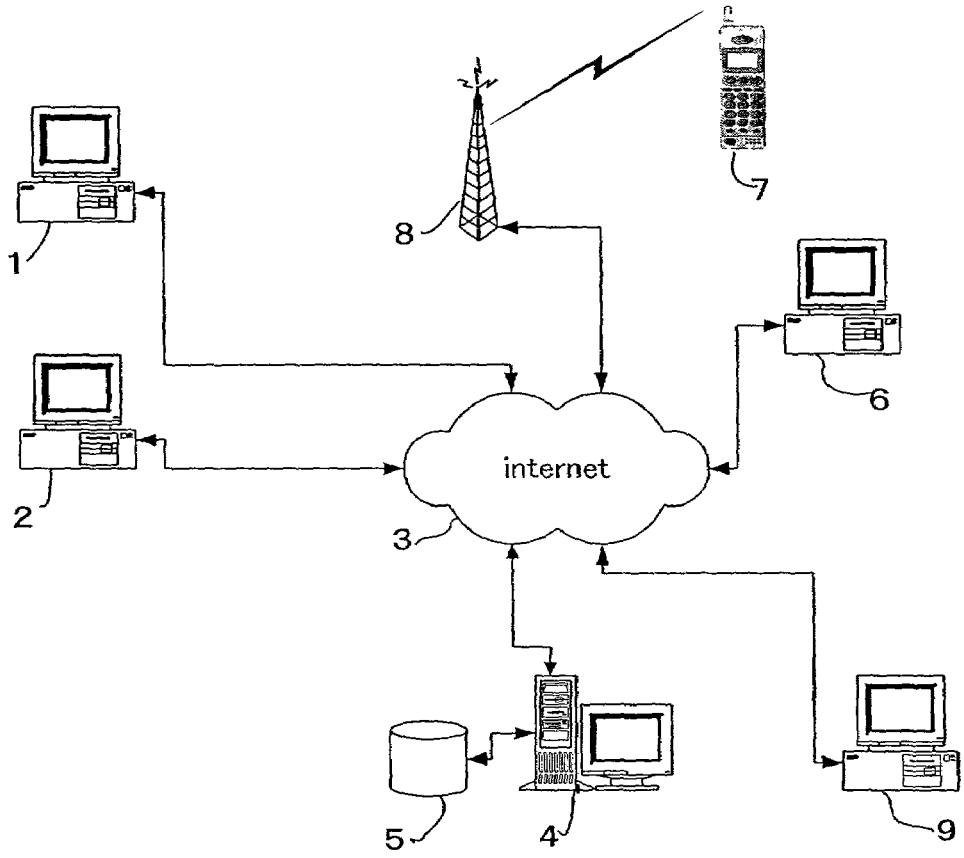
FIG. 2 is an explanatory view illustrating a schematic hardware construction of a system for viewing/listening evaluation of musical performance according to the present invention.

FIG. 2 is an explanatory view illustrating a schematic hardware of the present system, where the numerals 1 and 2 denote PCs (personal computers) used by the applicant of the music work. The applicant uses PC1 (or PC2) or the like to record a performance of the music work, converts the recorded performance into digital performance data, and transmits the converted data to an internet server 4 of the holder of the audition through an internet 3. Also, the applicant inputs and transmits the introduction data (name of applicant, self introduction by applicant, member introduction, title of music, introduction of music, part of lyrics, and others) of the music work on and through the internet homepage of the holder of the audition. The transmitted performance data and introduction data are stored into an external storage means 5 such as a HDD (hard disk drive) of the internet server 4. Alternatively, instead of transmission using PC1 (or PC2), the applicant may send the performance data to the holder of the audition by recording the performance on a cassette tape, MD, CD-R, or the like and sending the performance data together with the introduction data written on paper by postal mail. The music work recorded on the cassette tape, MD, CD-R, or the like is converted into suitable digital performance data such as mentioned above by the holder of the audition using a suitable conversion means. The introduction data written on paper is also converted into digital data by the holder of the audition. The converted performance data and introduction data are stored into external storage means 5 in the same manner as by on-line transmission.

Since the music work that is stored in external storage means 5 and has passed the primary examination is publicized on the aforesaid internet homepage, a registered audience can have an access to the music work to view and listen to the music work (the performance of the music work) and to input the evaluation result of the music work (data on the evaluation item) by using a general PC6 or the like that can run a browser program. A registered audience that has viewed or listened to the live performance or the performance of television broadcast accesses the internet homepage of the holder of the audition by using a portable terminal device 7 such as a portable telephone or by using a general PC6 to input the evaluation results of the viewing/listening. The reference numeral 8 denotes a wireless relay station for relaying between the portable terminal 7 and the internet 3. The reference numeral 9 denotes a general PC that is used by an adviser or a manager of the audition holder side in viewing and listening to the music work stored in external storage means 5 for performing an evaluation (evaluating) and making comments on the music work.

Figure 3:
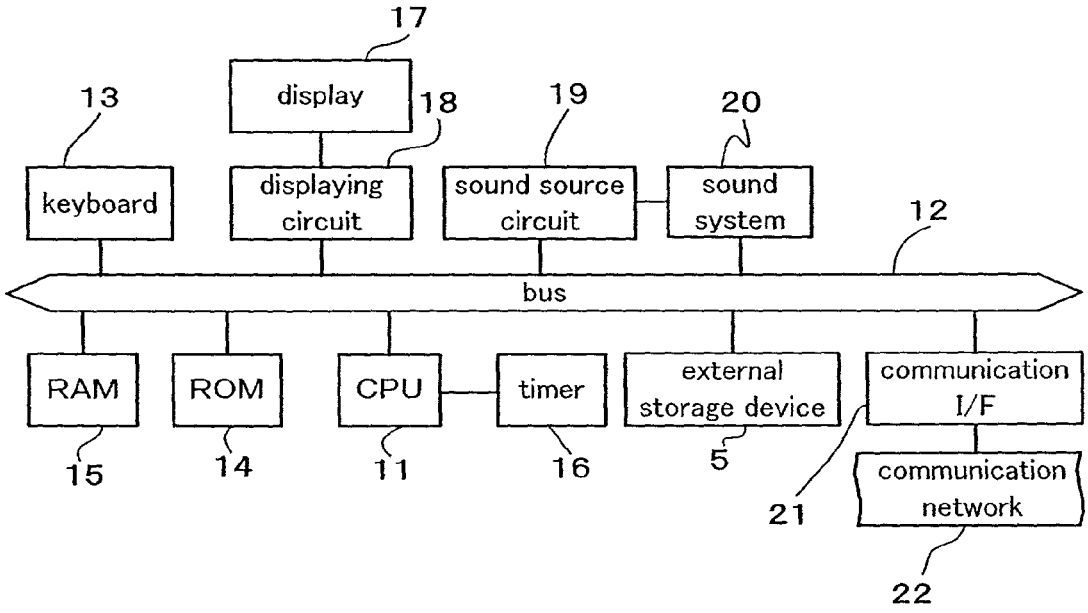
FIG. 3 is a block diagram illustrating a schematic construction of an internet server 4 according to an embodiment of the present invention.

FIG. 3 is a block diagram illustrating a schematic construction of the internet server 4. A CPU 11 executing the control of the whole device is connected via a bus 12 or the like to a keyboard 13, a ROM 14 for storing control programs executed by the CPU 11, various kinds of table data and others, a RAM 15 for temporarily storing introduction data and performance data transmitted from the applicant, for being used as a buffer in transmitting the performance data to the registered audiences, and for temporarily storing the calculation results and the like, a timer 16 for counting the interrupt time in the timer interrupt processing routine, various periods of time and time points, a liquid crystal display (LCD) 17 for displaying various information and others, displaying circuit 18 for the LCD 17, external storage means 5 for storing programs and HTML files of the present system, data groups and others such as the introduction data and performance data of the music works filed for application, and other elements. The programs of the present system are read from external storage means 5 into the work area of RAM 15 at the time of execution, and are executed by the CPU. The reference numeral 19 denotes a sound source circuit for generating sound signals on the basis of MIDI data based on the SMF (standard MIDI file) format or the like, and the generated sound signals are converted into sounds by a sound system 20 comprising an amplifier, a speaker, and others. If the performance data of the music works filed for application for an audition are made of sound data and MIDI data, the sound data is directly sent to the sound system 20, and the MIDI data is sent to the sound source circuit 19 for synchronized reproduction. External storage means 5 may include not only an HDD (hard disk drive) but also other storage means such as an FDD (floppy disk drive), a CD-ROM drive, and an MD drive. The reference numeral 21 denotes a communication interface, which enables connection to a communication network 22 such as an intranet or an internet. The hardware construction of the internet server 4 may be a general one and is known in the art. The PC1 and PC2 of the applicant, the PC6 of the audience, the PC9 of the adviser, and others in FIG. 2 are also made of general hardware constructions and may be the same as the constructions in FIG. 3.

Figure 4A:
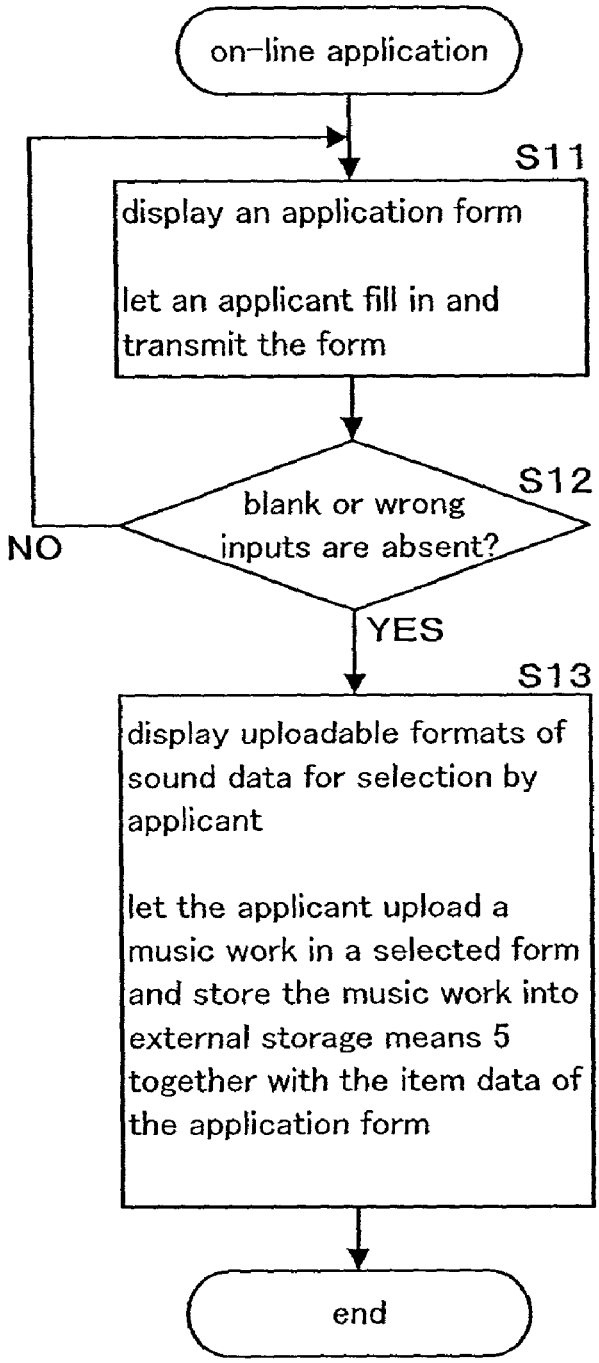
FIG. 4A is a flow chart for describing a method of on-line application.

FIG. 4A is a flowchart for describing anon-line application in the step S1 of FIG. 1. When the applicant starts an internet browser on the PC1 (or PC2) to input the URL of the application page of the audition holder, the PC1 is connected to the internet server 4 via the internet, and the HTML files for the application are sent to the PC1. When an application form (not illustrated) is displayed, the applicant inputs and transmits each item on the applicant and on the introduction data of the music works (step S11). If neither blank nor wrong inputs are found, the transmitted data are received (step S12). Next, uploadable formats of sound data (general formats such as WAV files, sound VQ files, MP3 files, and MIDI files) for the performance data are displayed. The applicant selects a suitable one of the formats, and transmits the performance data converted in advance into the selected format to the internet server 4. The introduction data and the performance data received by the internet server 4 are stored into a predetermined storage area of the external storage means 5 (step S13). The above-mentioned WAV files are files (not compressed) obtained by digital sampling of the sound data; the sound VQ files are files based on a music data, using compressing and expanding technique developed by YAMAHA Co., Ltd. for delivery of music; the MP3 files are files based on a sound, using compressing and expanding technique which is generally used in recent years; and the MIDI files are files according to a musical instrument digital interface format.

Figure 4B:
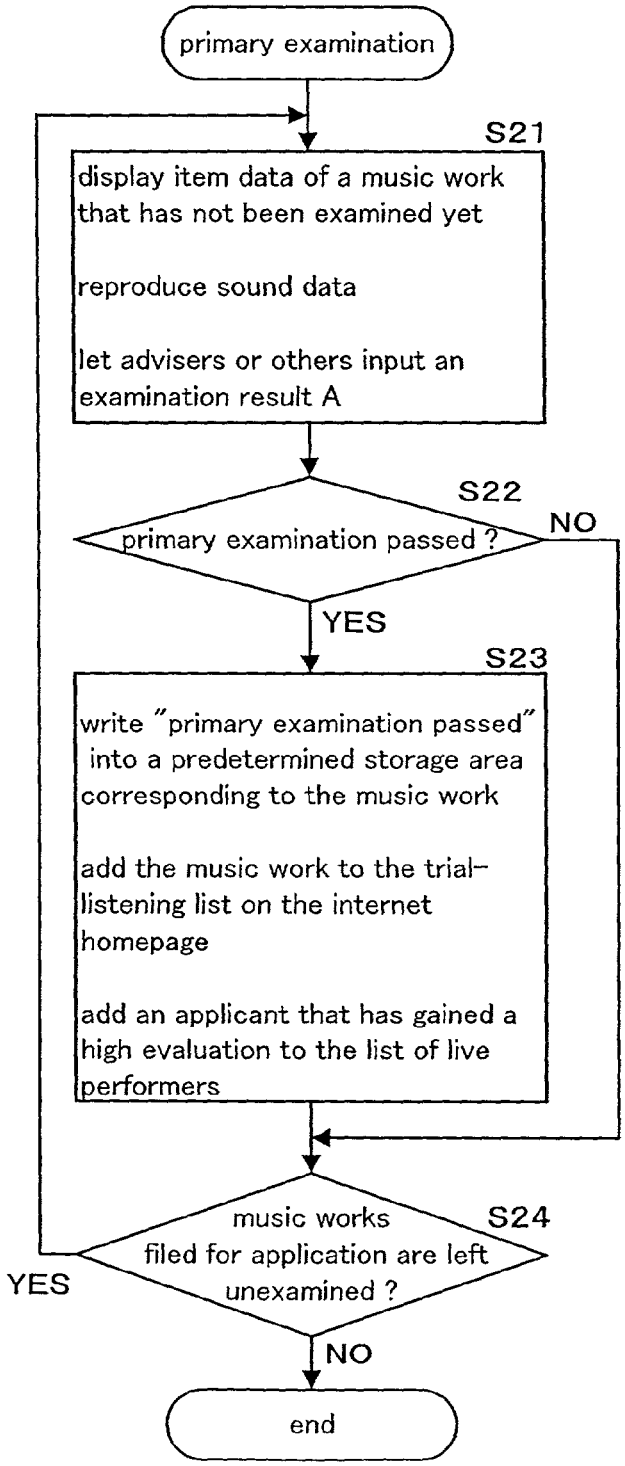
FIG. 4B is a flow chart for describing the procedure of primary examination.

FIG. 4B is a flowchart for describing the primary examination of the step S2 of FIG. 1. Each music work stored in the external storage means 5 is subjected to the primary examination by the audition holder or the adviser. The contents of the examination mainly include (1) whether the music work exceeds a level to withstand the trial listening or viewing/listening by general audiences and (2) whether the applicant is a person with whom one can make a contract that accords the purport of the audition. Those regarded as being above a predetermined level passes the test (1). Applicants who already have a contract with a music production office or a record company and applicants under specific circumstances are excluded because they presumably cannot make the aforesaid contract. Specifically, when the audition holder or the adviser make access to the internet server 4 by using the PC9 or the like, a HTML file for the primary examination is transmitted from the internet server 4, an internet homepage corresponding to the HTML file is displayed at the PC9 or the like, and each step is executed. That is, the audition holder or the adviser checks, on the internet homepage, each item of the introduction data sequentially with respect to the unexamined music works, performs reproduction and trial-listening of the performance data, and inputs an examination result A (evaluation score) (step S21). The input result A is then transmitted to the internet server 4, and at the internet server 4, the music work that has passed the examination is determined as "YES" in step S22, whereby the examination result A and the statement of having "passed the primary examination" are written into a corresponding storage area in external storage means 5, and the music work is added to the trial-listening list on the internet homepage. Music works having gained a fairly high evaluation are added to the performer's list for a live performance (step S23). The procedure from step S21 to step S23 is repeated until no music work is left unexamined.

Figure 5:
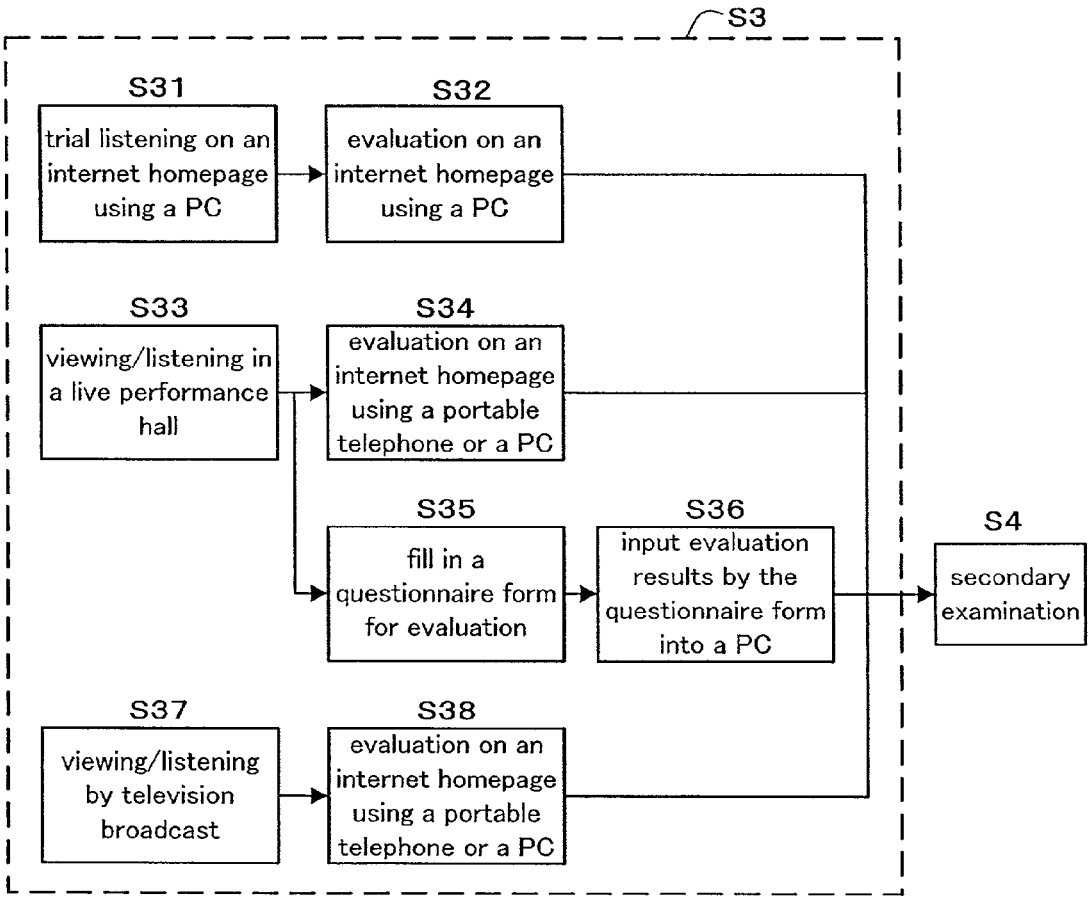
FIG. 5 is a flow chart for describing the flow of open audition through plural media and evaluation by audiences.

FIG. 5 is a flowchart for describing an open audition through plural media and evaluation carried out by an audience in the step S3 of FIG. 1. Music works that have passed the primary examination and enumerated in the aforesaid trial-listening list are introduced on the internet homepage, and subjected to successive trial listening by general audiences that have been registered in advance (registered audiences) (step S31) through PCs. Then, an evaluation result B is input on a subsequent homepage (step S32). For the music works that have been enumerated in the performer's list of live performance, a live performance of the music works by the applicant is held periodically (about several times a month) in a performance hall, and the registered audiences are given a chance to view and listen to an actual live performance (step S33). A registered audience that has viewed and listened to a music work through live performance makes access to the internet homepage by using a portable terminal device 7 or a PC6 to input an evaluation result C (step S34). For a registered audience that does not have means of connection to the internet, a questionnaire sheet (paper) is used to obtain an evaluation result C (step S35). Regarding the evaluation result by a questionnaire sheet, the audition holder converts the result on the sheet into electronic data (step S36) to input the data later. Video images of the aforesaid live performance are captured and periodically broadcast on television, so that the audiences are given a chance to view and listen to the live performance even if they do not attend the performance show (step S37). A registered audience that has viewed and listened to the live performance makes access to the internet homepage by using a portable terminal 7 or a PC6 to input an evaluation result D in the same manner as in the aforementioned case of live performance (step S38). Thus, the registered audiences are given viewing/listening chances through plural kinds of media such as an internet homepage, live performance in a performance hall, or television broadcast, whereby the audiences can perform evaluations corresponding to the characteristics of the media. Also, the audiences can selectively use one of evaluation inputting means depending to the media used.

Figure 8B:
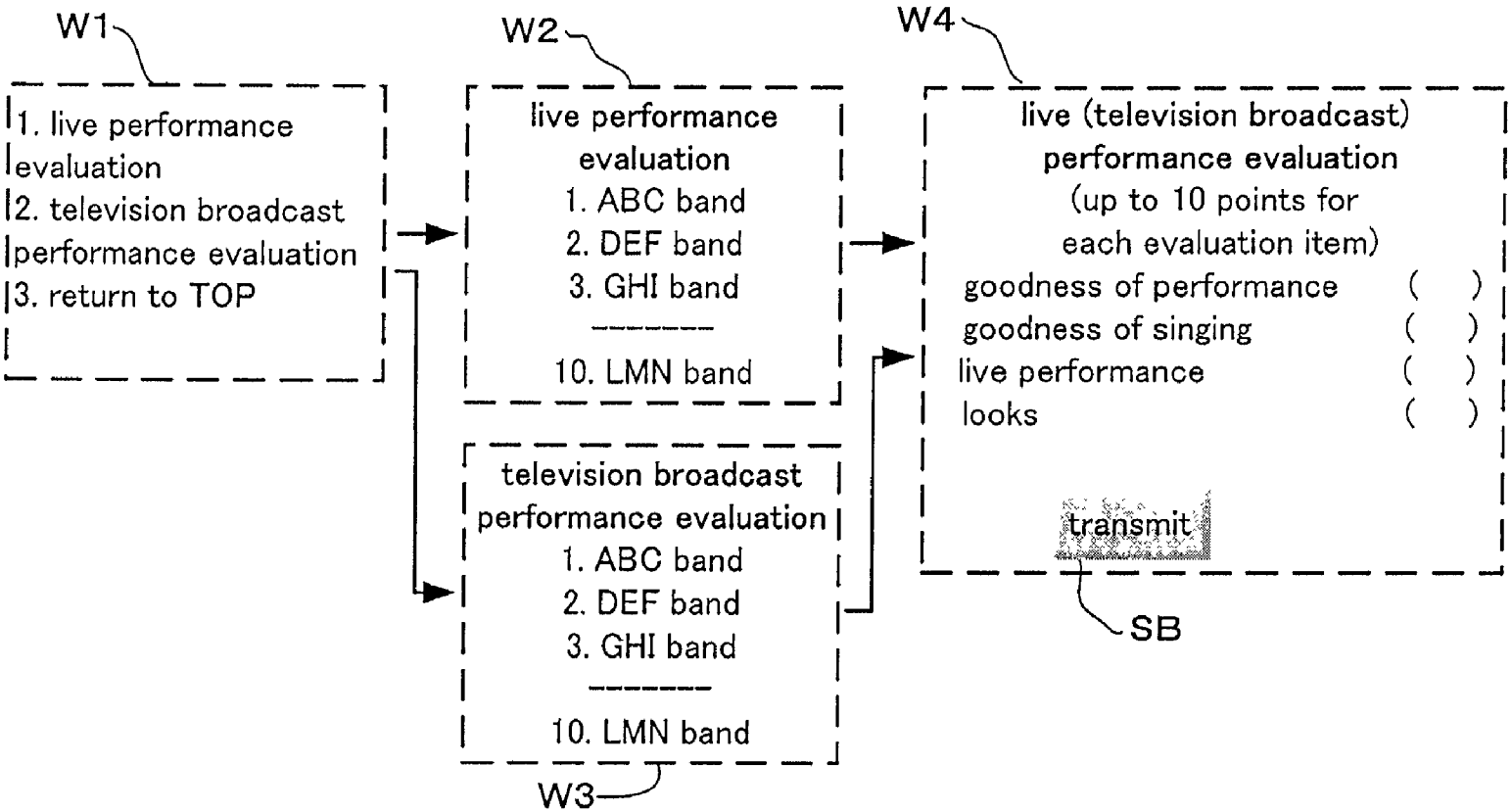
FIG. 8B is a screen for inputting an evaluation carried out on the basis of viewing/listening of live performance or television broadcast.

The aforesaid viewing/listening on the internet homepage includes only the listening of a stream-reproduced music work, so that the evaluation items include "lyrics", "melody", "goodness of performance", "goodness of singing", and others that can be determined simply by listening, as shown in FIG. 8A. The viewing/listening through live performance or television broadcast includes not only listening but also viewing of the performance of the applicant, so that the evaluation items include "live performance", "looks", and others, as shown in FIG. 8B. Further, as for the evaluation means after viewing/listening of the live performance or television broadcast, it is preferable that the audience is informed of a URL to be accessed by a portable telephone or a PC, the URL being valid for only a few days after viewing/listening, in the live performance hall or in the broadcasting programs so that the registered audiences is urged to input an evaluation result on the internet homepage before the audience forgets about its impression of the live performance. This is also effective for eliminating block votes.

Figure 6:
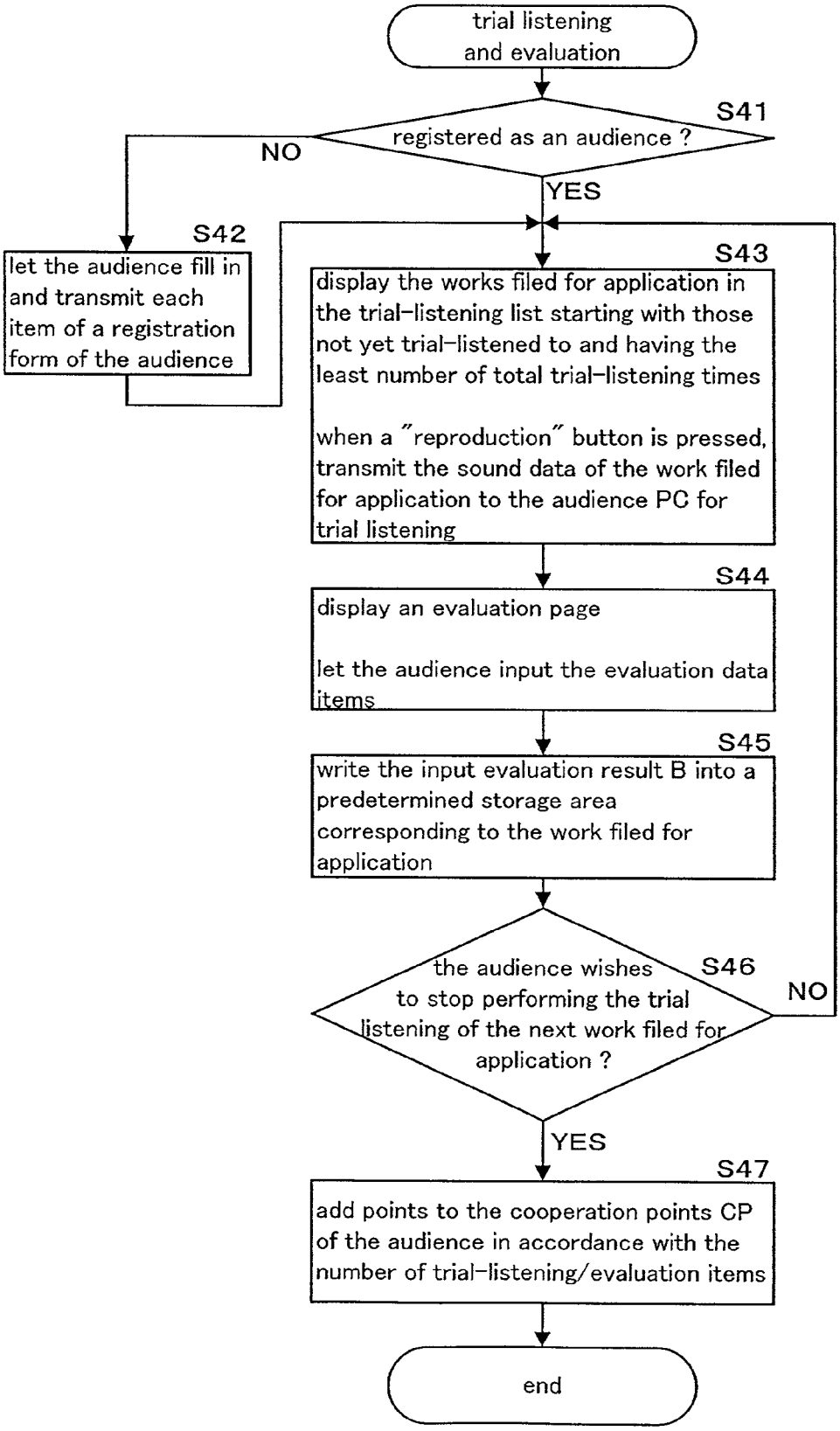
FIG. 6 is a flow chart for describing viewing/listening and evaluation on an internet homepage using a PC.

FIG. 6 is a flowchart for describing the trial listening and evaluation on the internet homepage using the PC of steps S31 and S32 in FIG. 5. When a HTML file stored in the external storage means 5 of the internet server 4 is transmitted according to a request from the PC6 or the like of a general audience or a registered audience, an internet homepage corresponding to the HTML file is displayed on the LCD of the PC6 or the like.

Steps of the internet homepage start when a general audience agreeing with the intent of the audition holder and wishing to view and listen to the music works makes access to the internet server 4 of the audition holder by the PC6 or the like. In step S41, an inquiry is made on whether the audience is already registered as an audience of the audition. Those who have not finished registration are requested to follow a simple registration procedure in step S42. A registered audience can proceed to the next step S43 by inputting the name and ID number. In step S43, the music works in the trial-listening list are presented (twenty pieces of music at a time) starting from those that are not yet listened to by the accessing audience and having the least number of trial-listening times by other registered audiences. When the registered audience presses a "reproduction" button on the internet homepage, the internet server 4 which received a signal caused by the pressing of the "reproduction" button stream-delivers (streams) first trial-listening data of the presented music works in the list (i.e. the twenty pieces of music) to the PC6 or the like. The PC6 or the like stream-reproduces the received data of the music works for trial listening. For streaming reproduction, one may use the aforesaid music data compression and expansion technique such as sound VQ or MP3 to reduce the amount of data to be transmitted, whereby a more smooth reproduction is made possible. When reproduction of one piece of music is finished, the evaluation page shown in FIG. 8A is displayed to have the registered audience input an evaluation data (step S44). Each evaluation item can be determined only by listening and can have a score up to ten points. When a ∇ mark is clicked, the numerals from 1 to 10 are displayed, whereby the audience can select among the displayed numerals. When the input is completed, the audience clicks a transmission button SB to transmit the input evaluation data to the internet server 4. At the internet server 4, the input data of each evaluation item is added as a numerical value (i.e. the points in the data are summed), and is written into a predetermined storage area corresponding to the music work as an evaluation result B (step S45). In step S46, at the PC6 or the like, an inquiry is made on whether the audience wishes to stop performing the trial listening of the next music work. When the audience wishes to continue the trial listening, the judgement is "NO", and steps S43 to S45 are repeated. If the audience inputs a signal to stop the trial listening, the procedure goes to step S47, where the internet server 4 which received the signal adds the number of music works the audience has trial listened during current access to the accumulated cooperation points CP of the registered audience (step S47).

In the present system, by the program stored in the internet server 4, every time a registered audience (person who has finished the registration procedure) performs trial listening and evaluation, points corresponding to the number of music works (items) the audience has trial listened and evaluated during current access are given to the audience as the accumulated cooperation points CP so as to have general audiences perform trial listening and evaluation of music works continually and eagerly. When the accumulated cooperation points CP exceed each predetermined number of points that is defined in a stepwise manner, the audience can obtain a commercial product that becomes more luxurious in accordance with the degree of cooperation, as a present.

Figure 7:
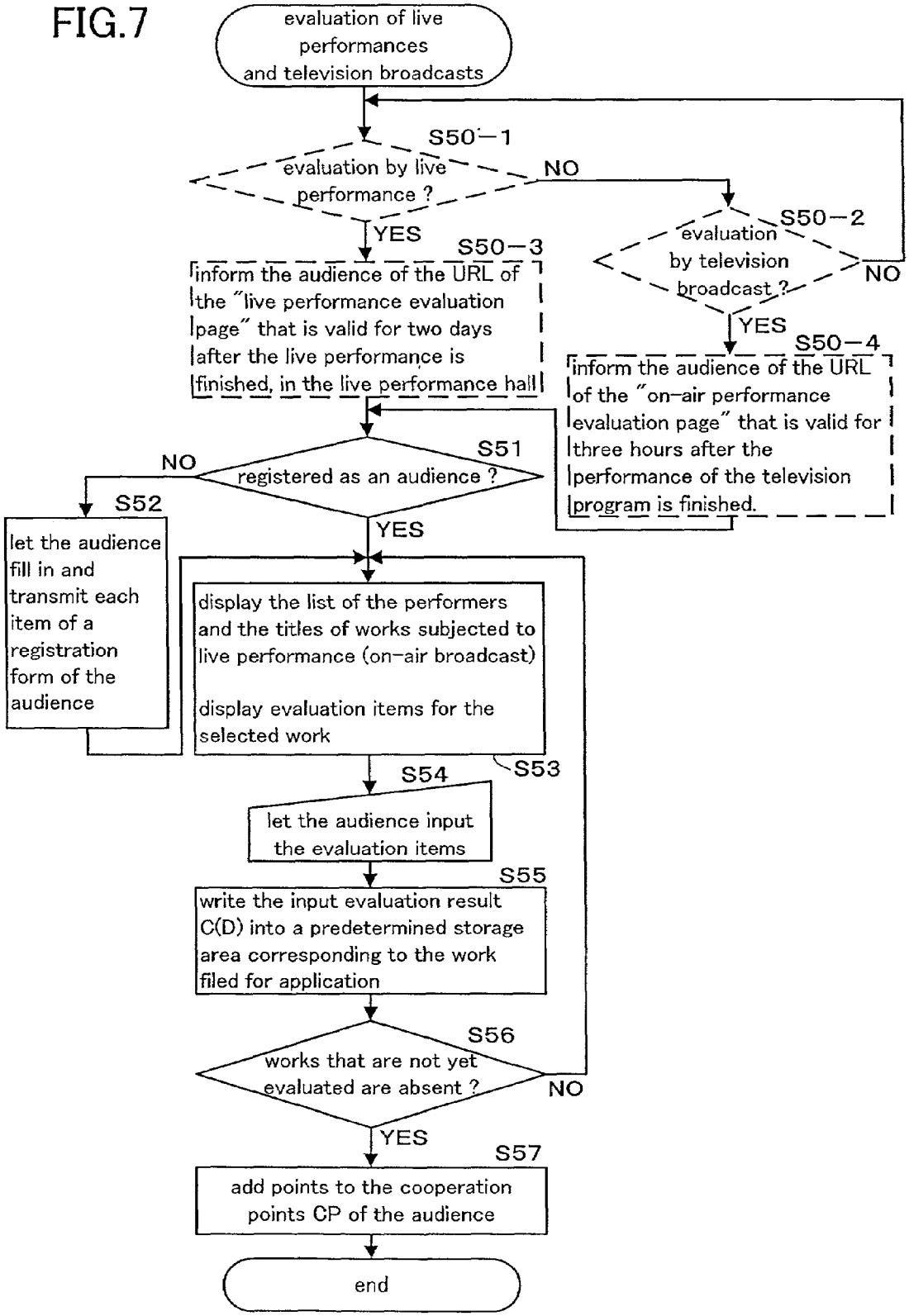
FIG. 7 is a flow chart for describing viewing/listening of live performance or television broadcast and subsequent evaluation on an internet homepage using a portable telephone set or a PC.

FIG. 7 is a flowchart for describing the trial listening in the live performance hall and the subsequent evaluation and others on the internet homepage using a portable telephone or a PC in the steps S33 and S34 of FIG. 5. As in the case shown in FIG. 6, when a HTML file stored in the external storage means 5 of the internet server 4 is transmitted according to a request from the portable telephone 7, the PC6 or the like of a general audience or a registered audience, an internet homepage corresponding to the HTML file is displayed on the display of the portable telephone 7, the PC6 or the like, and the steps S51–S57 described below are executed by using the homepage.

That is, first, in the live performance hall, the audition holder informs general participating audiences (including the registered audiences) of the URL of the internet homepage "live performance evaluation page" on which one can evaluate (one can input evaluation data of) the music works that will be played during the live performance show(steps S50-3). The URL is valid for several days (for example, two days). When general audiences having an interest and registered audiences make access to the internet server 4, and to enter the "live performance evaluation page" by using a portable telephone 7 or a PC6, the procedure goes to step S51 of FIG. 7. If an audience who is making access to the homepage has not finished the registration, the judgment in step S51 is "NO", and the procedure goes to step S52 to take registration procedure, before proceeding to the step S53. In step S53, the names of the performers of the music works of the live performance are displayed in a list, and a registered audience selects one of music works out of the list and inputs evaluation data for the selected music work.

For example, in step 53, the audience selects "1. live performance evaluation" on the display screen W1 shown in FIG. 8B, (cf. step S50-1), the audience selects the name of a most impressive performer on the next display screen W2 that displays the list of the performers, then an evaluation screen W4 is displayed for inputting evaluation (data on evaluation items) on the performers. Since the evaluation is based on the viewing/listening of actual playing of the music works in a live performance show, the evaluation includes items such as "live performance" and "looks" that are really seen and sensed. Subsequently, when the audience presses the transmission button SB after the audience inputs the evaluation data by giving a score up to 10 points for each evaluation item (step S54), the evaluation data is transmitted. Then, by the internet server 4 that received the evaluation data, the score for each evaluation item is summed to give an evaluation result C which is stored into a predetermined storage area of external storage means 5 corresponding to the music work (step S55). Further, when the audience wishes to evaluate the next music work, the judgement will be "NO" in step S56, and the steps from S53 to S55 are repeated. When the audience inputs a signal to stop evaluating the next music work, the judgement will be "YES" in step S56, and the points corresponding to the number of evaluated items are added to the accumulated cooperation points CP of the registered audience in step S57 by the internet server 4.

The trial listening by television broadcast and the subsequent evaluation on the internet homepage using a portable telephone or a PC in the steps of S37 and S38 of FIG. 5 may be the same as the aforementioned trial listening and evaluation in the live performance hall described in FIG. 7, and therefore the detailed explanation thereof is omitted here. On the display screen W1 of FIG. 8B, the audience selects "2. television broadcast performance evaluation" (cf. step S50-2). Then, screens W3 and W4 of FIG. 8B are displayed sequentially. Note that, during the television broadcast, the audience is informed of the URL of the "television broadcast performance evaluation page" (cf. step S50-4).

It should also be noted here that, when portable phone 7 is used for the data input, each screen W1 to W4 of FIG. 8B can be a simplified display suitable for a small display of the portable telephone 7; however, in the case of an access using PC6, the screen can preferably be a detailed display screen.

Figure 9:
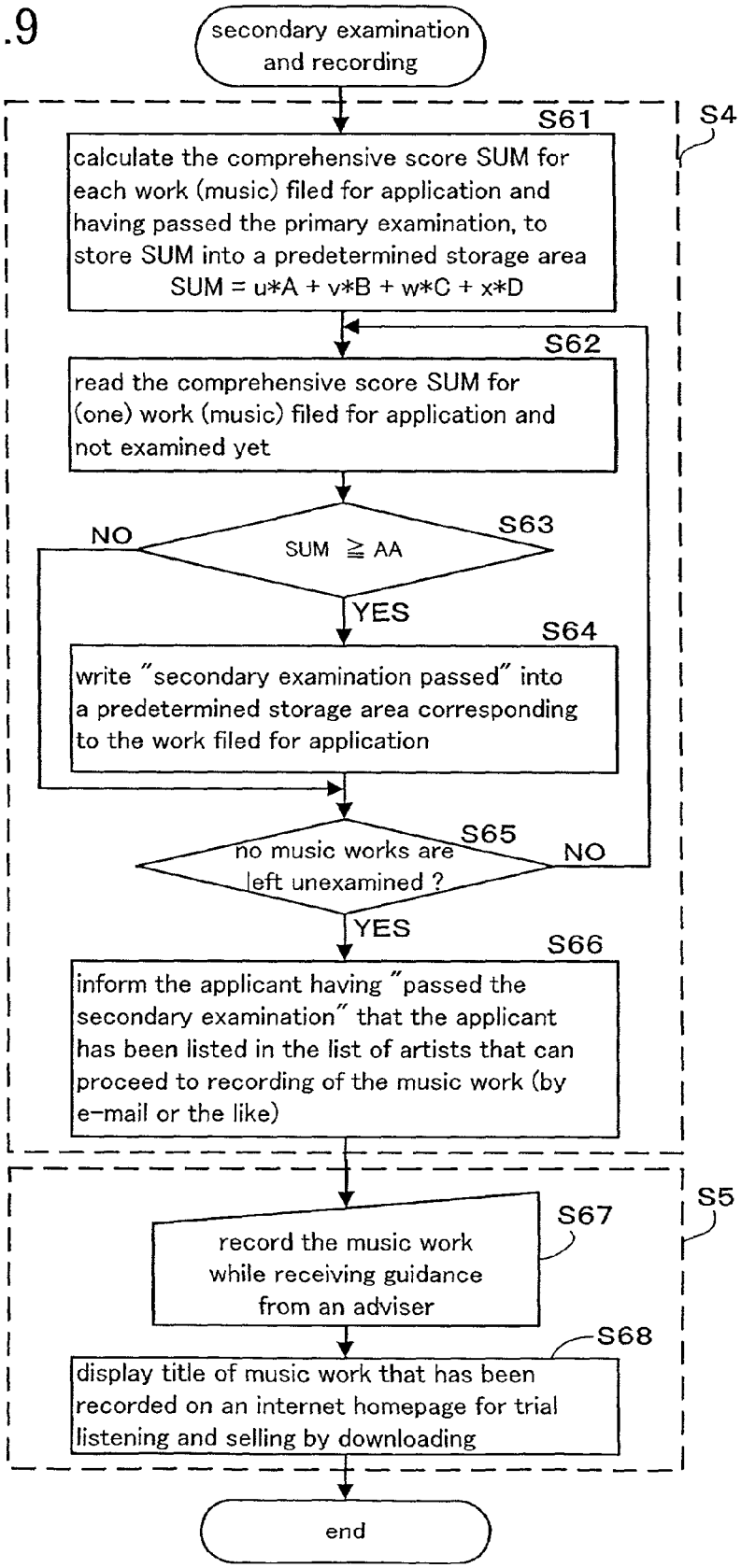
FIG. 9 is a flow chart for describing secondary examination and subsequent recording/music delivery.

FIG. 9 is a flowchart for describing a secondary examination and the subsequent recording and music delivery in the steps S4 and S5 of FIG. 1. When numerous registered audiences have performed viewing/listening and evaluation by means of plural media and when the evaluation is deemed to be definite (final), for example, when the number of evaluations performed by the registered audiences on the music work filed for application during a predetermined period of time exceeds 500 as an average, the internet server 4 executes steps according to the flow shown in FIG. 9.

That is, the music works that have been filed for application during a predetermined period of time and have passed the primary examination are successively subjected to the secondary examination by the internet server 4. The evaluation result A input in advance by the adviser, the evaluation result B based on the trial listening on the internet homepage, the evaluation result C of the live performance, and the evaluation result D of television broadcast are multiplied with weighting coefficients u, v, w, and x respectably, and then summed to obtain a comprehensive score SUM, which is stored into a predetermined storage area of RAM 15 corresponding to each music work (step S61). Next, the comprehensive score SUM of each music work is successively read out (step S62), and is compared with a predetermined secondary examination passage level score AA to determine whether the music work has passed the secondary examination (step S63). For the music works that have passed the secondary examination, a statement of having "passed the secondary examination" is written into a predetermined corresponding storage area of external storage means 5 (step S64). The steps from S62 to S64 are repeated until no music works are left unexamined (step S65). When all the music works are examined, the applicants who have (i.e. whose music work has) "passed the secondary examination" are informed that the applicants have passed the secondary examination and that the applicants have been enumerated in the list of performers that can proceed to recording, by means of an e-mail or the like (step S66). A schedule is arranged in order to have applicants who have passed the secondary examination record their music works using a studio for professionals while receiving a guidance from an adviser (step S67). The music works thus subjected to full-scale rerecording is planned to be publicized on the internet homepage of the audition holder, and to be sold to general audiences by downloading (i.e. delivering through the internet with charge fee) later on (step S68).

It should be noted that the programs of the present system and method stored in external storage means 5 can be recorded on a recording medium such as a CD-ROM to be sold. Alternatively, the programs can be sold by on-line transmission via the internet or the like.

In the aforesaid embodiment, the performance data consisting only of the sounds submitted by the applicant is stored in external storage means 5 and the performance data is reproduced in streams on the internet homepage to let the registered audiences listen to the performance data; however, the performance data stored in the external storage means 5 may include images and sounds such as in a promotion video tape. In this case, the evaluation items include not only items that can be determined by listening but also items that can be determined by seeing. That is, it is more preferable that evaluation items conforms more to the characteristics of the viewing/listening. For example, when the evaluation is performed by viewing and listening a live performances, the evaluation items should includes ones that can be determined based on real sense (real impression), since the audiences can more vividly sense the actual performances.

As described above, according to a method, a system, and a recording medium of the present invention for viewing/listening evaluation of a musical performance, evaluation for selection can be efficiently carried out on the basis of the sensitivities of general audiences, music works that can withstand general marketing to a larger extent can be extracted, and the general audiences are given a chance to be brought into contact with numerous music works filed for application for an audition and can expect to meet music works that can gain a compassion of the general audience by allowing the general audiences to view and/or listen to the music works through plural media such as an internet homepage, allowing the audiences to input evaluations corresponding to the characteristics of the respective media on and through the internet homepage, and examining the music works on the basis of the input evaluations. According to the present invention, the audition holder, the applicants, the general audiences, the evaluators, and others are communicably connected via the internet and perform each roles. Therefore, a series of procedures from the filing of music works for application to the evaluation of the music works and the selection of excellent music works can be efficiently and rationally carried out. For the medium by which the audience can listen to the music works only such as in the trial listening on an internet homepage and for the medium by which the audience can not only listen to but also view the music works (performances) such as in a live performance or a video broadcast, different contents of evaluation items are provided in accordance with the characteristics of the media, so that a more suitable and efficient evaluation can be carried out.

What is claimed is:

1. A method for viewing/listening evaluation of a musical performance, comprising the steps of:

storing introduction data and performance data of a music work filed for application through a network or a recording medium;

publicizing the introduction data of the music work on an internet homepage, transmitting at least a part of the performance data of the music work to audiences through the internet to allow the audiences to view and/or listen to the performance in accordance with a request from the audiences, and allowing the audiences to input evaluation data on a first evaluation item through the internet on the basis of viewing/listening results, said first evaluation item corresponding to a characteristic of the internet;

allowing the audiences to view and/or listen to the performance through a different medium, and allowing the audiences to input data on a second evaluation item on the internet homepage on the basis of viewing/listening results, said second evaluation item corresponding to a characteristic of the different medium; and comprehensively evaluating the performance on the basis of the input data of the first and second evaluation items.

2. The method according to claim 1, wherein the first evaluation item comprises an item that can be determined by listening to a performance of the music work, and the second evaluation item comprises an item that can be determined by seeing and listening.

3. The method according to claim 1, wherein the viewing/listening on the internet homepage includes streaming reproduction of the stored performance data of the music work through the internet for allowing the audiences to listen to the performance.

4. The method according to claim 1, wherein the viewing/listening through the different medium includes viewing/listening of a live performance of the music work by an applicant, or viewing/listening of a video images and sound of the live performance.

5. The method according to claim 1, further comprising the step of delivering and selling on the internet homepage the performance data of a music work that has been evaluated to be good in the comprehensive evaluation.

6. The method according to claim 1 wherein the step of evaluating the performance on basis of the input data of the first and second evaluation items comprises evaluating the music work.

7. The method according to claim 1 wherein the performance viewed and/or listened to through the internet is the same performance as the performance viewed and/or listened to in the different medium.

8. A system for viewing/listening evaluation of a musical performance, comprising:

storage means for storing introduction data and performance data of a music work filed for application through a network or a recording medium;

first control means for publicizing the introduction data of the music work on an internet homepage, transmitting at least a part of the performance data of the music work to audiences through the internet to allow the audiences to view and/or listen to the performance in accordance with a request from the audiences, and allowing the audiences to input data on a first evaluation item on the basis of viewing/listening results, said first evaluation item corresponding to a characteristic of the internet;

second control means for allowing the audiences to view and/or listen to the performance through a different medium, and allowing the audiences to input data on a second evaluation item on the internet homepage on the basis of viewing/listening results, said second evaluation item corresponding to a characteristic of the different medium; and evaluation means for comprehensively evaluating the performance on the basis of the input data of the first and second evaluation items.

9. The system according to claim 8 wherein the evaluation means for comprehensively evaluating the performance on the basis of the input data of the first and second evaluation items comprises evaluating the music work.

10. The system according to claim 8 wherein the performance viewed and/or listened to through the internet is the same performance as the performance viewed and/or listened to in the different medium.

11. A recording medium for storing steps to be performed by a computer, said steps comprising:

storing introduction data and performance data of a music work filed for application through a network or a recording medium;

publicizing the introduction data of the music work on an internet homepage, transmitting at least a part of the performance data of the music work to audiences through the internet to allow the audiences to view and/or listen to a performance in accordance with a request from the audiences, and allowing the audiences to input data on a first evaluation item on the basis of viewing/listening results, said first evaluation item corresponding to a characteristic of the internet;

allowing the audiences to view and/or listen to a performance through a different medium, and allowing the audiences to input data on a second evaluation item on the internet homepage on the basis of viewing/listening results, said second evaluation time corresponding to a characteristic of the different medium; and comprehensively evaluating the performance on the basis of the input data of the first and second evaluation items.

12. The recording medium according to claim 11 wherein comprehensively evaluating the performance on the basis of the input data of the first and second evaluation items comprises evaluating the music work.

13. The recording medium according to claim 11 wherein the performance viewed and/or listened to through the internet is the same performance as the performance viewed and/or listened to in the different medium.

14. A method for viewing/listening evaluation of a musical performance, comprising the steps of:

storing data of a music work filed for application through a network or a recording medium;

allowing audiences to view and/or listen to one or more performances of the music work through plural media including an internet homepage, and allowing the audiences to input data on respective evaluation items corresponding to characteristics of the media on the internet homepage every time the audiences view and/or listen to the one or more performances of the music work; and comprehensively evaluating the one or more performances on the basis of the input data on the evaluation items of the plural media.

15. The method according to claim 14 wherein comprehensively evaluating the one or more performances on the basis of the input data on the evaluation items of the plural media comprises evaluating the music work.

* * * * *